US009003720B2

(12) United States Patent
Siqueiros

(10) Patent No.: US 9,003,720 B2
(45) Date of Patent: Apr. 14, 2015

(54) METHOD AND APPARATUS FOR LIFTING AND LEVELING A CONCRETE PANEL

(71) Applicant: Baltazar J. Siqueiros, San Dimas, CA (US)

(72) Inventor: Baltazar J. Siqueiros, San Dimas, CA (US)

( * ) Notice: Subject to any disclaimer, the term of this patent is extended or adjusted under 35 U.S.C. 154(b) by 0 days.

(21) Appl. No.: 14/513,549

(22) Filed: Oct. 14, 2014

(65) Prior Publication Data

US 2015/0059261 A1 Mar. 5, 2015

Related U.S. Application Data

(62) Division of application No. 13/594,604, filed on Aug. 24, 2012, now Pat. No. 8,875,471.

(51) Int. Cl.

| | |
|---|---|
| ***E04B 1/35*** | (2006.01) |
| ***E01C 19/52*** | (2006.01) |
| ***E04G 21/14*** | (2006.01) |
| ***E01C 23/04*** | (2006.01) |
| ***E04B 1/41*** | (2006.01) |

(52) U.S. Cl.

CPC ..... *E01C 19/52* (2013.01); *E04G 21/142* (2013.01); *E04B 1/3511* (2013.01); *E01C 23/04* (2013.01); *E04B 1/4157* (2013.01)

(58) Field of Classification Search

USPC ..... 52/125.1–125.5, 126.1, 704, 707, 52/745.19, 745.2, 698–700, 708

See application file for complete search history.

(56) References Cited

U.S. PATENT DOCUMENTS

| | | | | | |
|---|---|---|---|---|---|
| 3,705,469 | A | * | 12/1972 | Eriksson | 52/125.4 |
| 4,179,151 | A | * | 12/1979 | Tye | 294/89 |
| 4,204,711 | A | * | 5/1980 | Lancelot et al. | 294/89 |
| 5,242,249 | A | * | 9/1993 | Grayson | 405/286 |
| 2003/0231929 | A1 | * | 12/2003 | Lee | 404/34 |

FOREIGN PATENT DOCUMENTS

| | | | |
|---|---|---|---|
| JP | 10037109 | * | 2/1998 |
| JP | 2011117128 A | * | 6/2011 |
| KR | 2011043026 A | * | 4/2011 |

* cited by examiner

*Primary Examiner* — Adriana Figueroa
(74) *Attorney, Agent, or Firm* — Morland C. Fischer

(57) ABSTRACT

A lifting apparatus to be embedded within a precast concrete panel or slab to enable the panel to be lifted, positioned atop a road bed, and elevated above the road bed. A lifting apparatus is located at each corner of the panel. Each lifting apparatus has a threaded sleeve extending through the panel to receive a removable threaded lifting bolt by which to establish a lifting point at which a lifting force is applied to lift and position the panel. When the threaded lifting bolt is rotated completely through the threaded sleeve, a pushing force is applied against a base plate, whereby to elevate the panel above the road bed as is necessary to make the panel level with adjacent panels during the construction or repair of a roadway. Grout is pumped through the panel to fill the space between the panel and the road bed.

10 Claims, 6 Drawing Sheets

METHOD AND APPARATUS FOR LIFTING AND LEVELING A CONCRETE PANEL

CROSS REFERENCE TO RELATED APPLICATIONS

This application is a division of patent application Ser. No. 13/594,604 filed Aug. 24, 2012.

BACKGROUND OF THE INVENTION

1. Field of the Invention

This invention relates to an apparatus to be embedded within a precast concrete panel or slab to enable the panel to be lifted, laid upon a road bed, raised above the road bed and leveled with respect to adjacent panels. The apparatus has particular application in roadway construction and/or repair where several panels must be laid end-to-end and side-by-side one another.

2. Background Art

As new communities are built, it is essential to have a roadway system to link each community with neighboring communities. Therefore, a series of highways and freeways are constructed to support vehicular traffic. A common technique for building such roadways is to lay a number of heavy precast concrete panels or slabs end-to-end and side-by-side one another. However, all of the panels must be level with respect to one another to establish a smooth and continuous driving surface.

The foregoing is typically accomplished by grading the road bed upon which each concrete panel will be laid. The process of grading requires the availability and deployment of road grading machinery and the manpower to operate the machinery. Where an existing roadway is being repaired and replaced, the road work usually occurs at night and requires that the roadway be closed to traffic. In this case, the new concrete panels must be installed quickly so that the repaired roadway can reopen the next morning. However, having to first grade the road bed before the panels can be laid adds to the labor force, raises the corresponding construction costs, and increases the time necessary to complete the job. What is even more, the completion time is further increased, because convenient lifting points are not readily available by which to lift and position the conventional concrete panel on the road bed.

SUMMARY OF THE INVENTION

In general terms, a lifting apparatus is disclosed to be embedded within a precast concrete panel or slab to enable the panel to be lifted off its transport, laid upon an ungraded road bed, and leveled with respect to adjacent panels that are employed during the construction and/or repair of a roadway. In accordance with the preferred embodiment, a lifting apparatus is embedded at each corner of the concrete panel while the panel is being cast in order to establish convenient and reliable lifting points at which the panel is relatively quickly and easily lifted.

The lifting apparatus includes a flat base plate located at the bottom of the concrete panel. A short section of pipe stands upwardly from the base plate. The bottom of a threaded cylindrical sleeve which extends through the panel between the top and bottom thereof is removably received within the pipe so as to engage the base plate. A pair of retaining bars are bent around the sleeve to help anchor the sleeve in place within the precast panel. A threaded end cap is rotated into removable mating engagement with the top of the threaded cylindrical sleeve.

After the concrete panel has been transported to the work site, the end cap is removed from the cylindrical sleeve of the lifting apparatus. A hoisting cylinder having a hoist coupler pivotally connected thereto is positioned on top of the panel, and a threaded lifting bolt is inserted through the hoist cylinder and rotated into detachable connection with the threaded sleeve of the lifting apparatus. The hoist coupler and lifting bolt establish a lifting point at which a crane can engage and lift the panel from its means of transport for relocation atop the road bed so as to lie end-to-end and side-by-side adjacent panels. The crane is then detached from the lifting point, and the lifting bolt is rotated through the sleeve to push the base plate off the sleeve and against the road bed below the panel. The bolt is continuously advanced through the sleeve until the concrete panel is elevated and leveled relative to its adjacent panels. Next, a supply of grout or a similar filler is pumped below the concrete panel by way of grout tubes that run through the panel. The grout fills the space between the bottom of the panel and the ungraded road bed. The lifting bolt is detached from the sleeve, and the sleeve is filled with cement so that the concrete panel establishes a smooth and continuous roadway to support vehicular traffic.

DESCRIPTION OF THE PREFERRED EMBODIMENT

Figure 2:
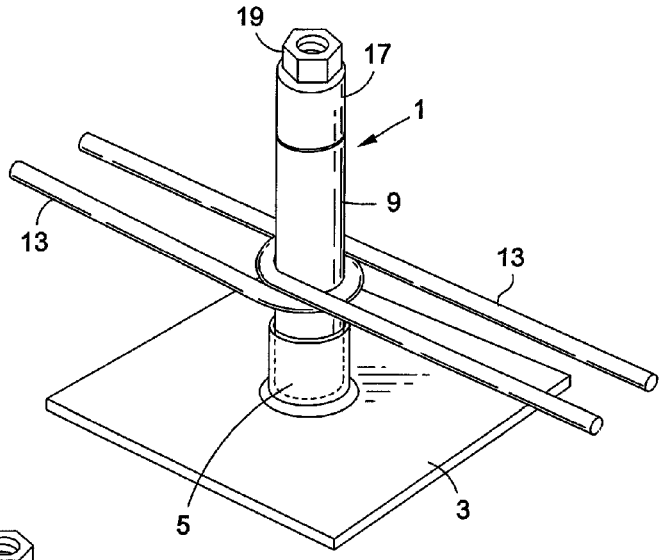
FIG. 2 shows the lifting apparatus of FIG. 1 in an assembled configuration.
Figure 1:
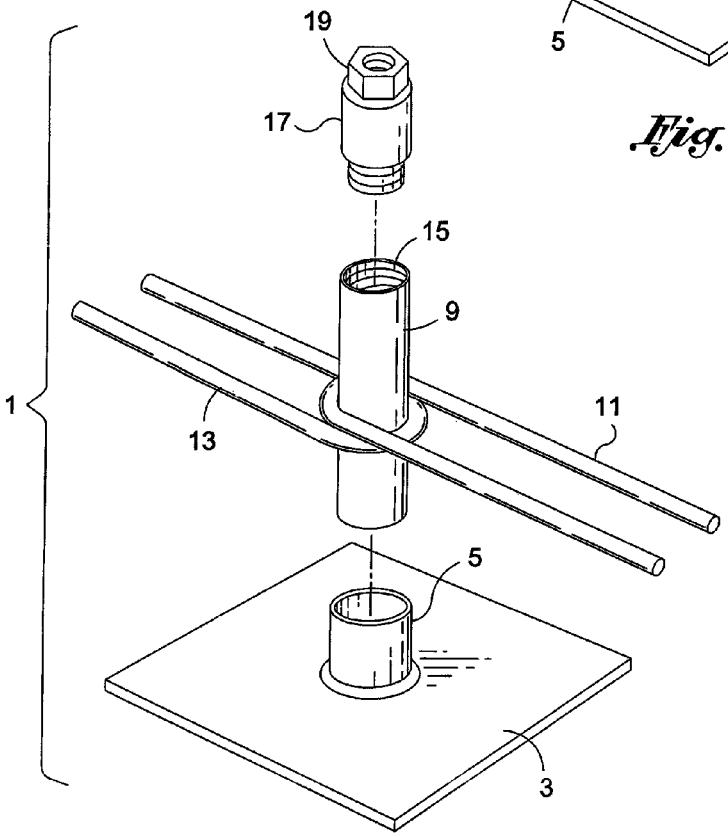
FIG. 1 is an exploded view of the apparatus for lifting and leveling a precast concrete panel or slab according to a preferred embodiment of the present invention.
Figure 3:
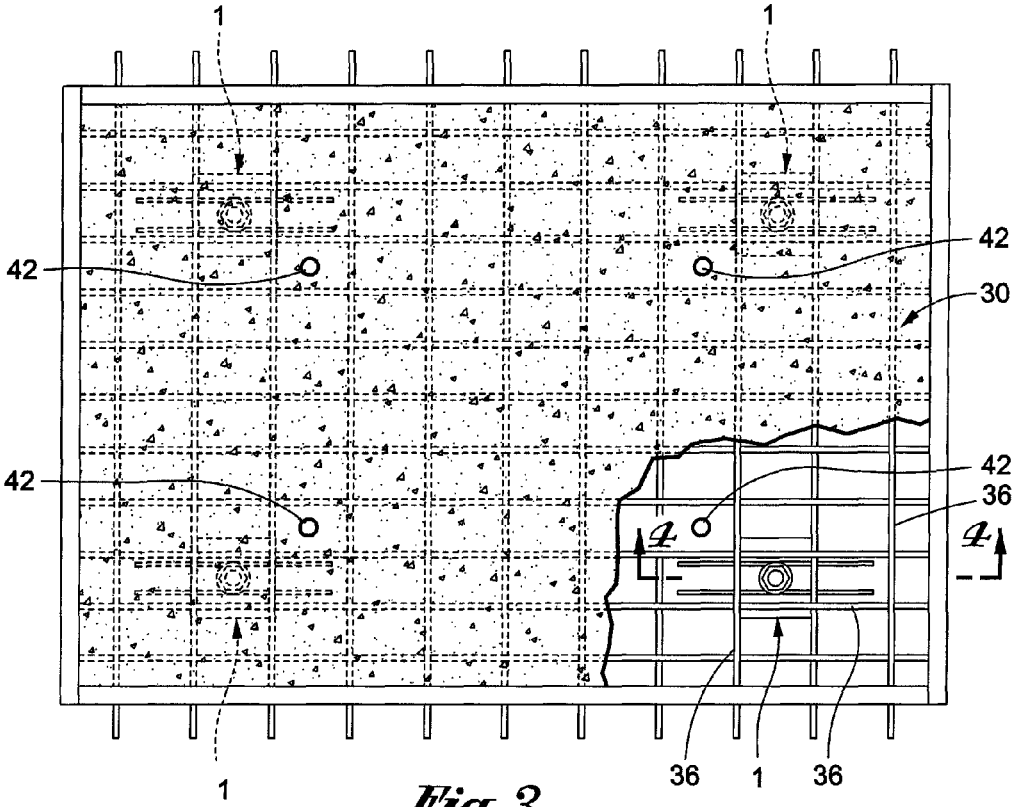
FIG. 3 shows a lifting apparatus like that illustrated in FIG. 2 being embedded in and located at each corner of a precast concrete panel during manufacture of the panel.

Turning now to the drawings, details are provided of an apparatus having a dual function of enabling a concrete panel or slab to first be lifted and moved to a construction site and then elevated and leveled with respect to a surface upon which the concrete panel is laid. The lifting apparatus herein disclosed has particular application for use during roadway (e.g., freeway) construction and/or repair where a large number of heavy precast concrete panels must be laid end-to-end and side-by-side one another to create a smooth and continuous driveway over which automotive traffic will travel. However, it is to be understood that the apparatus and the method of using this invention are applicable to the construction of any flat surface to be produced by a series of panels or slabs that are manufactured from concrete or the like and are laid over a road bed or a similar support foundation that is typically irregular (i.e., ungraded) and covered with coarse material.

Referring initially to FIGS. 1-4, there is shown a preferred embodiment for the lifting apparatus 1 to be embedded within a precast concrete panel (designated 30 in FIGS. 3 and 4) to be used for example, during the construction and/or repair of a roadway. The apparatus 1 is manufactured from steel or any other suitable durable material that is adapted to resist deformation under heavy loads and tensile forces. The apparatus 1 includes a flat base plate 3 to be located along the bottom of the panel 30. A section of pipe 5 is affixed (e.g., welded) to and stands upwardly from the base plate 3. The pipe 5 has an ideal diameter of 3 to 4 cm and an ideal height of 4 to 5 cm.

Figure 6:
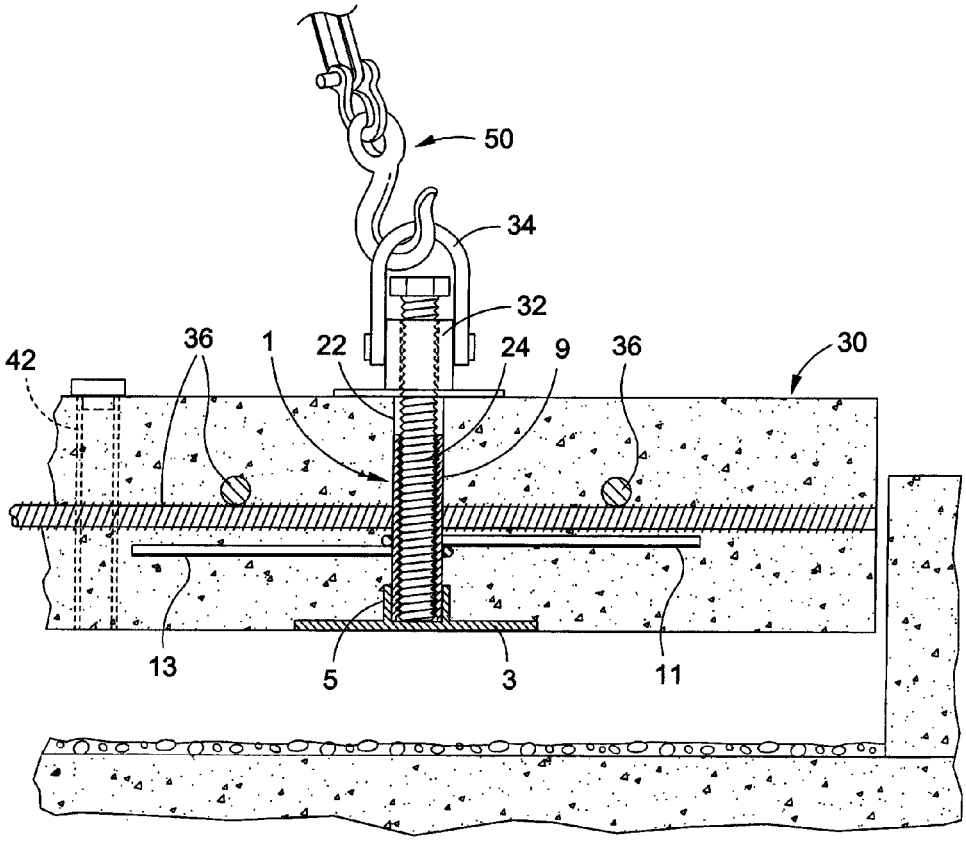
FIG. 6 shows a crane applying a lifting force to the concrete panel of FIG. 5 by way of a lifting bolt detachably connected to the lifting apparatus.
Figure 7:
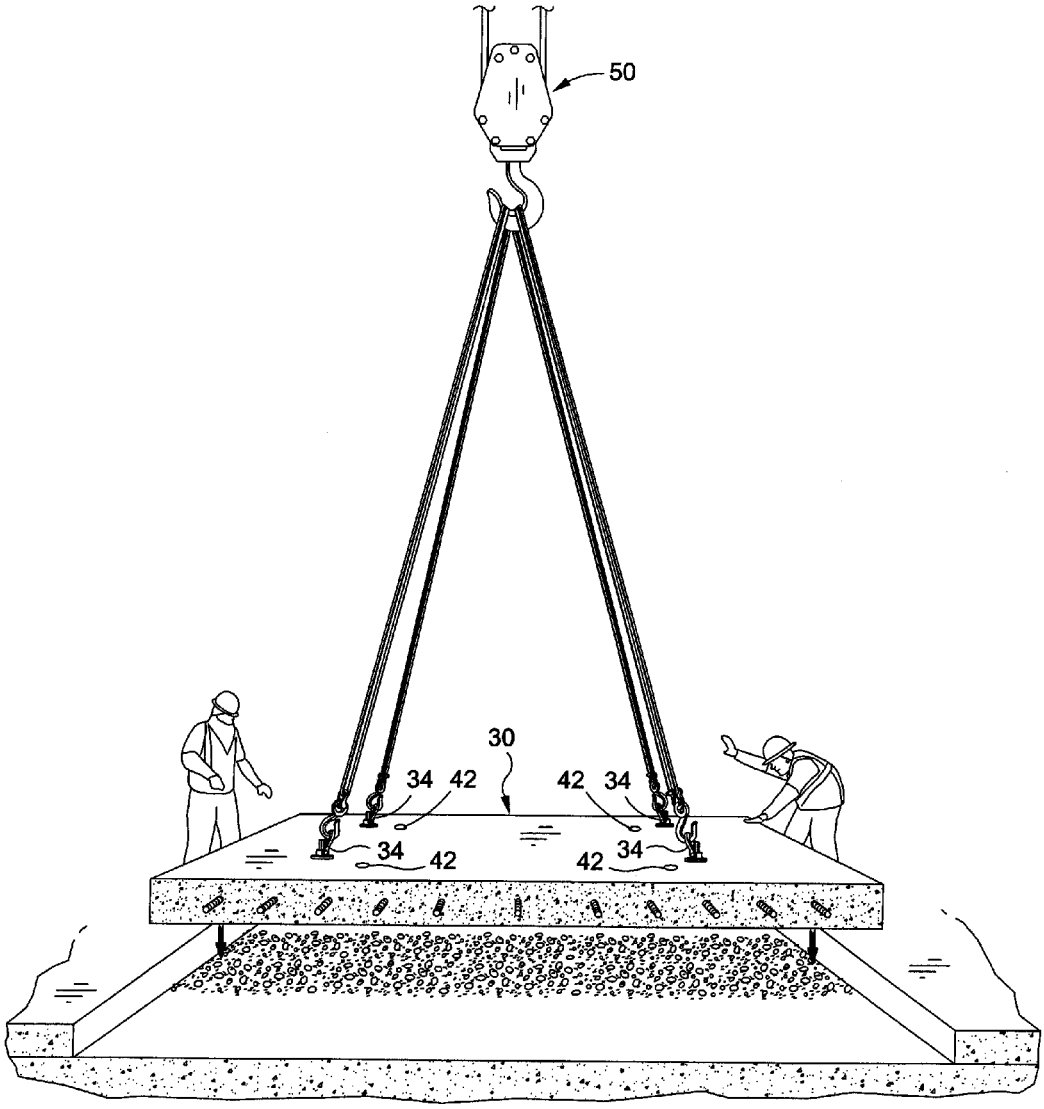
FIG. 7 shows the concrete panel of FIG. 6 being lifted and positioned atop a road bed.

A hollow cylindrical sleeve 9 is sized so that the bottom thereof is removably received within and surrounded by the upstanding pipe 5. The sleeve 9 has an ideal height of 15 to 17 cm. The sleeve 9 is seated upon the flat base plate 3 so as to be supported by and rise above the pipe 5. With the lifting apparatus 1 embedded in the concrete panel 30 of FIG. 4, the sleeve 9 extends through the panel between the top thereof and the base plate 3 located at the bottom. One or more retaining bars are affixed (e.g., welded) to the cylindrical sleeve 9. The retaining bars are preferably a pair of rebars 11 and 13 or the like that are bent around the sleeve 9 so as to extend outwardly and in opposite directions. The rebars 11 and 13 serve as anchors to prevent a displacement or shifting of the sleeve 9 when the base plate 3 is separated from the sleeve for a purpose that will soon be explained. Moreover, the rebars 11 and 13 affixed to the sleeve 9 cooperate with the usual rebars (designated 36 in FIGS. 3 and 4) that are also embedded within the concrete panel 30 to provide additional structural reinforcement and hold the apparatus 1 in place as a lifting force is applied thereto in the manner shown in FIG. 6.

Figure 4:
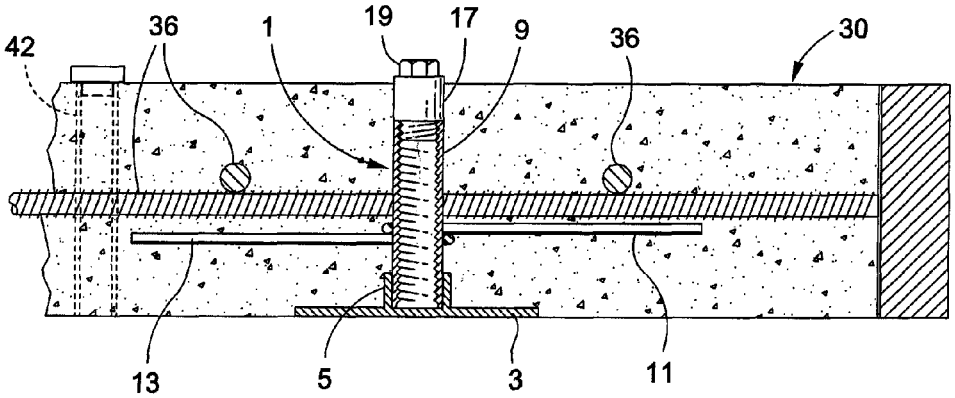
FIG. 4 shows the lifting apparatus of FIG. 2 embedded within the concrete panel and having an end cap removably attached thereto.
Figure 5:
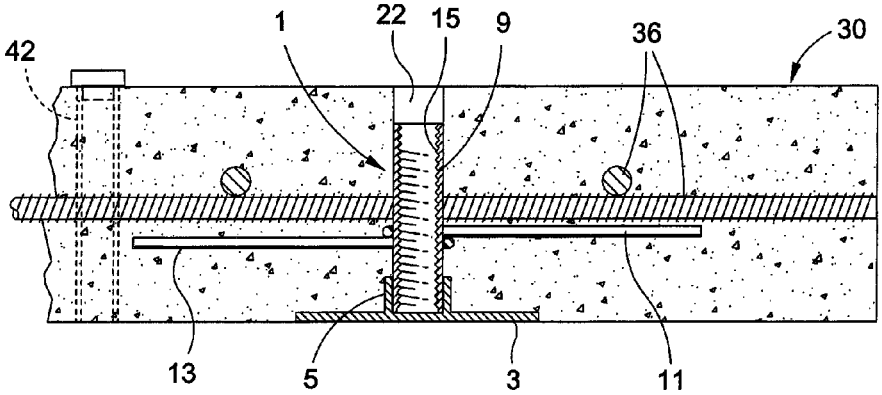
FIG. 5 shows the lifting apparatus of FIG. 4 with the end cap removed.

A set of screw threads (15 in FIGS. 1 and 5) runs around and along the inside of the hollow cylindrical sleeve 9. Like the apparatus 1, the screw threads 15 have a dual function. More particularly, in one case, the apparatus 1 includes a threaded end cap 17 to be removably connected to the top of the sleeve 9 at the internal screw threads 15 thereof. As is best shown in FIG. 4, during the casting of the concrete panel 30, the threaded end cap 17 is rotated into mating engagement with the threaded sleeve 9. The end cap 17 stands about 5 cm above the top of the sleeve 9 and serves as a detachable plug to prevent the sleeve from being filled with concrete. A head (e.g., a hex nut) 19 is located at the top of the end cap 17. The head 19 is sized and shaped so as to be engaged by a tool (not shown) to which a rotational force is applied to cause the end cap 17 to be rotated out of its mating engagement with the sleeve 9 once the panel has been cast but before the concrete has had time to fully cure. When the threaded end cap 17 is removed from the threaded sleeve 9, a temporary gap 22 (best shown in FIG. 5) is left in the panel 30 above the sleeve 9.

After the concrete panel 30 has been manufactured and moved to a work site, the panel must be lifted off its transport and laid in place atop the road bed next to one or more adjacent panels. To accomplish the foregoing, and by way of a second application for the screw threads 15 inside the cylindrical sleeve 9, a threaded lifting bolt 24 is detachably connected to the threaded sleeve 9 of the lifting apparatus 1 that is embedded within the concrete panel 30 (best shown in FIG. 6).

More particularly, and referring now to FIGS. 4-7 of the drawings, a conventional hoisting cylinder 32 is laid upon the panel 30 above the gap 22. The threaded lifting bolt 24 is then pushed through the hoisting cylinder 32 and rotated (e.g., by means of an air gun or the like) into mating engagement with the threaded sleeve 9 of the lifting apparatus 1. The lifting bolt 24 is ideally about 28 to 32 cm long so as to extend completely through the sleeve and engage the base plate 3 at the bottom of the panel 30. To facilitate the connection (and removal) of the threaded lifting bolt 24 to the internal screw threads 15 of the sleeve 9, the bolt is preferably covered with grease or a similar lubricant.

With the hoisting cylinder 32 connected to the concrete panel 30 by means of the lifting bolt 24 being mated to the threaded sleeve 9 of the lifting apparatus 1 embedded within the panel, a crane 50 (of FIG. 6) or the like applies a lifting force to the usual hoist coupler 34 that is pivotally connected to the hoisting cylinder 32. The lifting force is transferred to the lifting apparatus 1 via the lifting bolt 24 so that the concrete panel 30 can be lifted from its transport, repositioned and lowered into place along the road bed (best shown in FIG. 7). In order to reliably lift and position the concrete panel 30, a lifting apparatus 1 is embedded at each of the corners of the panel in the manner shown in FIG. 3. Therefore, a total of four lifting apparatus 1 having respective hoisting cylinders 32 and hoist couplers 34 are employed to enable the crane 50 to lift and position each panel. However, it is to be understood that the total number of lifting apparatus embedded within the concrete panel 30 is not to be considered as a limitation of this invention.

Figure 8:
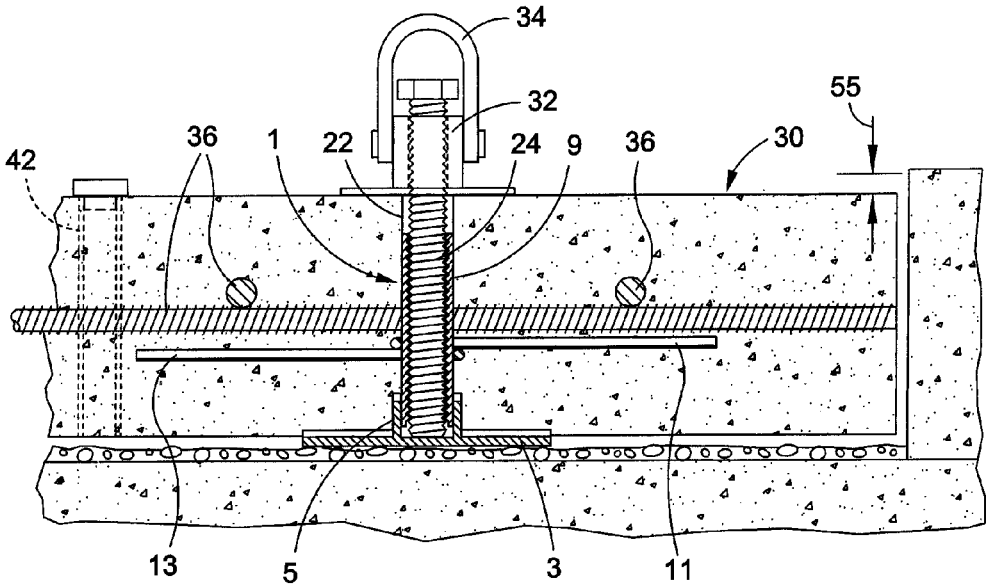
FIG. 8 shows the concrete panel of FIG. 7 after the panel has been lowered to the road bed to lie adjacent another panel.

After the concrete panel has been laid in place atop the road bed as shown in FIG. 8, the crane 50 is detached from the hoist couplers 34. When the panel 30 is laid alongside another panel of a new or a repaired roadway, the panels must be level with one another to accommodate vehicular traffic. Accordingly, it may be necessary to adjust the elevation of the panel 30 relative to the road bed so that the level of panel 30 is consistent with the level of those adjacent panels which have been already laid in place. By virtue of the threaded cylindrical sleeve 9 which extends through the concrete panel 30 and the lifting bolt 24 rotated through the sleeve, the elevation of the panel 30 above the road bed can be selectively adjusted so that all four sides are level with adjacent panels.

Figure 9:
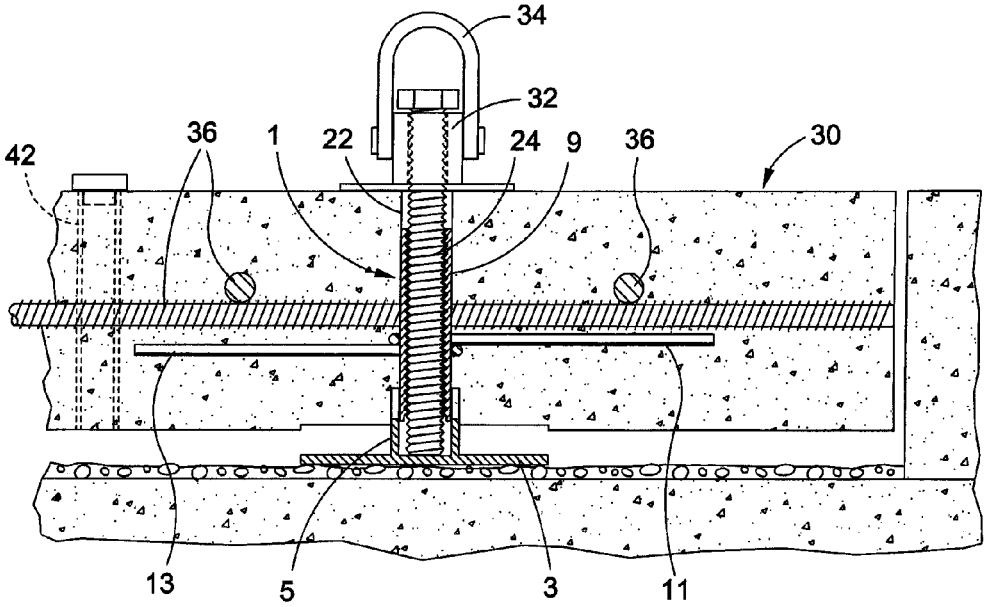
FIG. 9 shows the concrete panel of FIG. 8 after it has been elevated above the road bed and leveled relative to the adjacent panel.

As is best shown in FIG. 9, each lifting bolt 24 is rotated completely through its sleeve 9 to engage the base plate 3 at the bottom of the concrete panel 30. The continued rotation and axial displacement of the lifting bolt 24 through the sleeve 9 causes the base plate 3 (and the pipe section 5 standing upwardly therefrom) to separate from the sleeve 9 and be pushed against the road bed below panel 30. The base plate 3 is preferably coated with a conventional bond break to facilitate the separation of the base plate from the bottom of the panel 30 in response to the pushing force generated by lifting bolt 24 moving towards and against base plate 3.

The greater the axial displacement of the lifting bolt 24 through the cylindrical sleeve 9, the higher the concrete panel 30 is lifted above the road bed. The elevation of each corner of the panel 30 is raised by a distance 55 (of FIG. 8) until the panel and its adjacent panels are all aligned to create a continuous and uniformly level road surface, regardless of the irregularities of the original ungraded road bed over which the panel 30 is laid.

Figure 10:
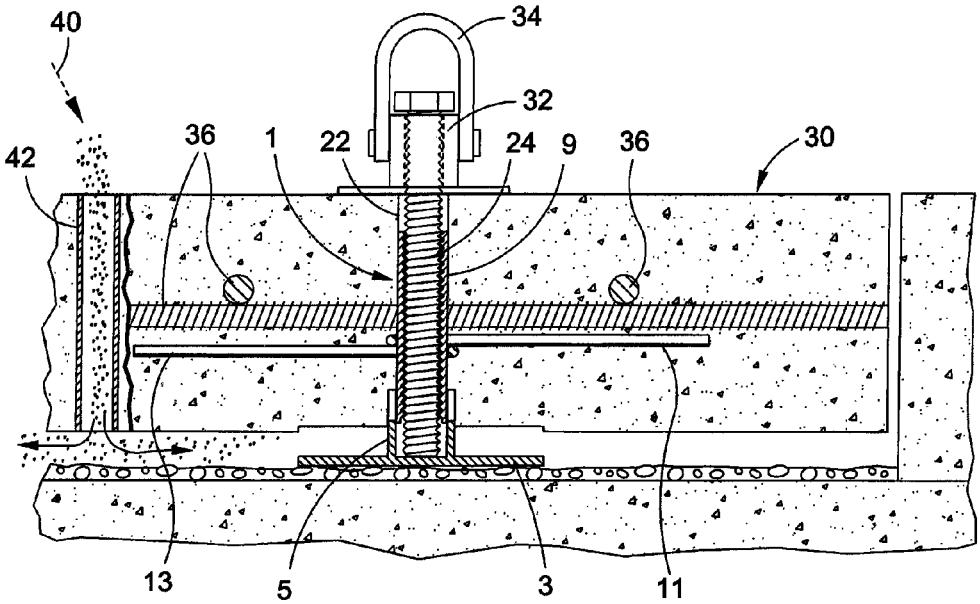
FIG. 10 shows the concrete panel of FIG. 9 with grout being pumped through the concrete panel and into the space between the bottom of the panel and the road bed.

Once the concrete panel 30 has been elevated above the road bed as is necessary to create a level road surface, a urethane grout 40 or any other suitable filler is pumped down each of a series of grout tubes 42 that are embedded within the concrete panel 30 alongside the lifting apparatus 1. As is best shown in FIG. 10, the grout 40 flows through the grout tubes 42 to fill and solidify the space between the bottom of the elevated panel 30 and the road bed.

Figure 11:
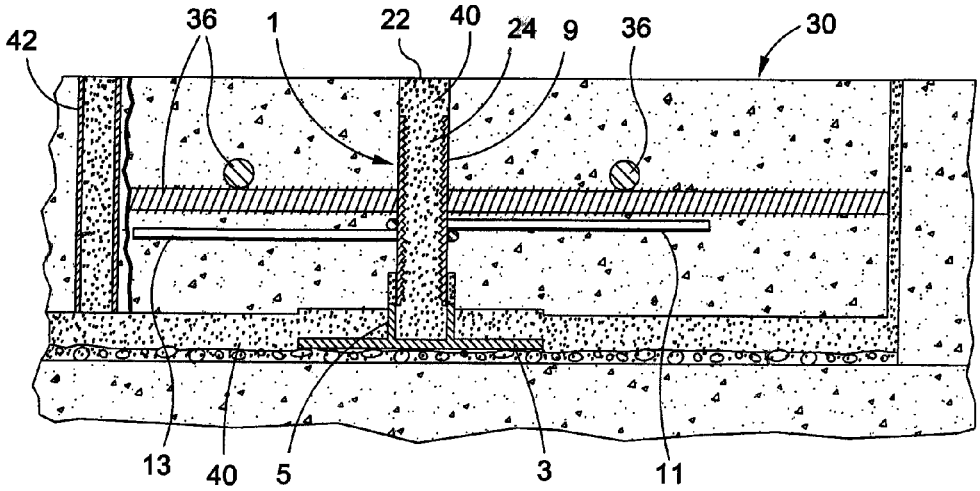
FIG. 11 shows the concrete panel of FIG. 10 after the grout has solidified and the lifting bolt has been detached from the lifting apparatus.

After the pumping process has concluded, the concrete panel 30 has been leveled in the manner just described, and the grout 40 has hardened below the panel 30, the lifting bolt 24 is rotated out of and removed from the sleeve 9. Then, as shown in FIG. 11, the gap 22 lying above the sleeve 9 of each embedded lifting apparatus 1 is filled with cement, grout, or the like to create a flat surface across the top of the panel. Additional precast concrete panels can be lifted, positioned, laid end-to-end and side-by-side one another, and leveled to efficiently create a new roadway or repair an existing roadway within less time and with the expenditure of less man hours and cost than had the road bed first been graded as is customary in traditional road building techniques.

The invention claimed is:

1. An apparatus embedded within a concrete panel to enable the concrete panel to be lifted and transported to a surface and elevated above the surface, wherein the concrete panel has a top and a bottom and said apparatus comprises:

a threaded sleeve having a length so as to extend through the concrete panel between the top and the bottom thereof;

an elevator lying at the bottom of the concrete panel below said threaded sleeve;

a sleeve support affixed to and standing upwardly from said elevator so that said threaded sleeve is removably received within and surrounded by said sleeve support; and a threaded lifting bolt removably connected to said threaded sleeve and having first and opposite ends, the first end of said threaded lifting bolt positioned relative to the concrete panel so as to receive rotational forces applied thereto in first and opposite directions and a lifting force applied thereto by which the concrete panel is lifted and transported to the surface, wherein a rotational force applied in said first direction to the first end of said threaded lifting bolt rotates said threaded lifting bolt downwardly and axially through said threaded sleeve so that the opposite end of said threaded lifting bolt applies a pushing force against said elevator for causing said elevator to be displaced from the bottom of the concrete panel until said elevator and said sleeve support affixed thereto are detached from the concrete panel and said elevator is pushed against the surface to which the concrete panel has been transported, whereby a corresponding uplifting force is generated for elevating the concrete panel above the surface, and wherein a rotational force applied in said opposite direction to the first end of said threaded lifting bolt rotates said threaded lifting bolt upwardly and axially through said threaded sleeve, whereby said threaded lifting bolt is removed from said threaded sleeve.

2. The apparatus recited in claim 1 wherein said threaded lifting bolt is sized so that said first end thereof extends upwardly from said threaded sleeve and above the top of said concrete panel at which said rotational forces and said lifting force are applied thereto.

3. The apparatus recited in claim 1, wherein said elevator is a flat plate lying below said sleeve support and across said threaded sleeve at the bottom of the concrete panel, such that the rotational force applied in the first direction to the first end of said threaded lifting bolt rotates said threaded lifting bolt downwardly and axially through said threaded sleeve so that the opposite end of said threaded lifting bolt applies said pushing force against said flat plate.

4. The apparatus recited in claim 3, wherein said sleeve support is a section of pipe affixed to and standing upwardly from said flat plate and said threaded sleeve is a cylinder having a diameter which is smaller than the diameter of said sleeve support pipe section, whereby said cylindrical threaded sleeve is removably received within and surrounded by said sleeve support pipe section.

5. The apparatus recited in claim 1, further comprising a plug by which to fill at least some of said threaded sleeve after said threaded lifting bolt has been rotated upwardly and axially through and removed from said threaded sleeve.

6. The apparatus recited in claim 5, wherein said plug to fill at least some of said threaded sleeve is grout.

7. The apparatus recited in claim 1, further comprising a threaded end cap detachably connected to said threaded sleeve at the top of the concrete panel to prevent said threaded sleeve from becoming filled with concrete during the manufacture of the concrete panel within which said apparatus is embedded, said threaded end cap being detached from said threaded sleeve prior to said threaded lifting bolt being removably connected to said threaded sleeve.

8. The apparatus recited in claim 1, further comprising at least one retaining bar embedded within the concrete panel and attached to said threaded sleeve to anchor said apparatus in place within said concrete panel.

9. The apparatus recited in claim 8, further comprising a plurality of reinforcement bars embedded within the concrete panel, said at least one retaining bar which is attached to said threaded sleeve extending from said threaded sleeve so as to engage said plurality of reinforcement bars to further anchor said apparatus in place within the concrete panel.

10. The apparatus recited in claim 1, further comprising at least one filler tube running through the concrete panel between the top and the bottom thereof and a filler material carried by said filler tube to be deposited between the bottom of the concrete panel and the surface above with the concrete panel has been elevated.

* * * * *